US006820850B2

(12) United States Patent
Coleman

(10) Patent No.: US 6,820,850 B2
(45) Date of Patent: Nov. 23, 2004

(54) SUPPORT FOR WASHER OR DRYER

(76) Inventor: Clarence Michael Coleman, 4142 Medford Dr., Concord, NC (US) 28207

( * ) Notice: Subject to any disclaimer, the term of this patent is extended or adjusted under 35 U.S.C. 154(b) by 0 days.

(21) Appl. No.: 10/128,845

(22) Filed: Apr. 24, 2002

(65) Prior Publication Data

US 2003/0201375 A1 Oct. 30, 2003

(51) Int. Cl.[7] ..... A47B 91/00; A47G 29/00; B65D 19/00

(52) U.S. Cl. ..... 248/346.07; 248/346.06; 312/351.11

(58) Field of Search ..... 248/346.07, 346.06, 248/346.01, 646, 188.1, 188.6, 916, 424, 429, 430, 647, 648, 649, 657, 678, 129, 346.03; 312/351.11, 351.12, 334.7, 334.8, 334.6, 334.27, 334.31, 201, 198; 280/638, 37

(56) References Cited

U.S. PATENT DOCUMENTS 1,974,158 A * 9/1934 Okenfuss ..... 248/346.06
2,300,165 A 4/1942 Mustafa
2,498,392 A * 2/1950 Boyle ..... 248/657
4,123,126 A * 10/1978 Querengasser ..... 211/1.57
4,166,638 A * 9/1979 De Prado ..... 280/638
4,261,626 A * 4/1981 Hornbacher ..... 211/50
4,333,322 A 6/1982 Billings et al.
4,503,973 A * 3/1985 Andersson ..... 206/386
4,680,948 A 7/1987 Rummel et al.
4,693,526 A 9/1987 Spiegel
4,758,057 A 7/1988 Spiegel
4,919,384 A * 4/1990 Grimberg ..... 248/646
4,967,994 A * 11/1990 Rice ..... 248/649
5,357,777 A * 10/1994 Castellano ..... 72/305
5,630,696 A 5/1997 Gordon
5,697,586 A 12/1997 Lybarger
5,879,014 A * 3/1999 Price ..... 280/47.18
5,906,422 A * 5/1999 Golias, Sr. ..... 312/334.12
6,027,190 A * 2/2000 Stewart et al. ..... 312/201
6,077,029 A 6/2000 Johnson
6,102,348 A 8/2000 O'Neill
6,131,871 A * 10/2000 Bernhardt et al. ..... 248/424
6,155,527 A * 12/2000 Muyskens ..... 108/51.3
6,158,704 A 12/2000 O'Neill
6,196,777 B1 * 3/2001 Price ..... 410/101
6,203,031 B1 * 3/2001 Leverington ..... 280/35
6,260,815 B1 * 7/2001 Allen ..... 248/176.3
6,371,584 B1 * 4/2002 Alreck ..... 312/235.1
6,375,235 B1 * 4/2002 Mehmen ..... 292/128
6,427,966 B1 * 8/2002 Blumenschein ..... 248/678

* cited by examiner

*Primary Examiner*—Anita King
*Assistant Examiner*—Amy J. Sterling
(74) *Attorney, Agent, or Firm*—Adams Evans P.A.

(57) ABSTRACT

A support for moving a large appliance, particularly a washing machine or dryer, includes first and second brackets for mounting on a base surface, a slide assembly connected to the first and second brackets, and a frame for mounting the appliance. The frame is connected to the slide assembly for slidable movement relative to the first and second brackets whereby the appliance moves in unison with the frame. The slide assembly includes two sets of interconnected slide tracks cooperating with each other and a plurality of rollers to facilitate sliding movement of the frame. The perimeter of the frame is adjustable to accommodate appliances of varying depth.

18 Claims, 8 Drawing Sheets

SUPPORT FOR WASHER OR DRYER

TECHNICAL FIELD AND BACKGROUND OF THE INVENTION

The invention relates to a support frame for a large appliance, particularly a washer or dryer, that enables persons of varying strength to easily and quickly move the large appliance to access areas normally obstructed by the appliance. Large household appliances such as washers and dryers are typically positioned directly against a wall for practical reasons such as proximity to electrical outlets and conserving space, as well as for aesthetic reasons. Over time dust and other debris collects on the floor directly underneath the appliance, and in the crevice between the appliance and the wall. In addition, it is periodically necessary to access the back of the appliance for maintenance or repairs of the appliance. Also, at times it is necessary to access the electrical outlet directly behind the appliance to which the appliance is connected.

Appliances such as washing machines and dryers are relatively heavy and are quite cumbersome to move. It is virtually impossible for a person of average strength to lift them off the floor, and attempting to do so can lead to injury. Sliding the appliance along the floor is difficult and can scratch the floor. Therefore, there is a need for an apparatus that enables one of average strength to easily move a heavy appliance several feet away from its normal position adjacent to a wall, and then quickly move the appliance back to its normal position without causing damage to the floor or surrounding objects.

In an effort to overcome and eliminate the aforementioned problems, the present invention was conceived.

SUMMARY OF THE INVENTION

Therefore it is an object of the present invention to provide an apparatus that enables a person to easily move a heavy appliance, such as a washing machine or dryer, several feet from its original position to access areas normally obstructed by the appliance, and back again to its original position.

It is another object of the invention to provide an apparatus for moving a large appliance that does not require reassembly each time the appliance is to be moved.

It is yet another object of the invention to provide an apparatus for moving an appliance that is specifically sized for use with a washing machine or dryer.

These and other objectives of the present invention are achieved by providing a support for moving an appliance having first and second brackets for mounting on a base surface, a slide assembly connected to the first and second brackets, and a frame for mounting the appliance. The frame is connected to the slide assembly for slidable movement relative to the first and second brackets whereby the appliance moves in unison with the frame.

According to one preferred embodiment of the invention, the support is for moving a washing machine or dryer.

According to another preferred embodiment of the invention, the support includes means for adjusting the dimensions of the perimeter of the frame to accommodate appliances of varying size.

According to yet another preferred embodiment of the invention, the slide assembly includes a first plurality of interconnected slide tracks cooperating with each other and a plurality of rollers disposed within at least one of the slide tracks to facilitate sliding movement. At least one of the slide tracks is affixed to the first bracket and at least one of the slide tracks is connected to the frame. A second plurality of slide tracks cooperates with each other and a plurality of rollers are disposed within at least one of the slide tracks to facilitate sliding movement. At least one of the slide tracks is affixed to the second bracket and at least one of the slide tracks is connected to the frame. The frame moves in unison with the slide tracks connected thereto.

According to yet another preferred embodiment of the invention, a wheel is attached to the frame and in contact with the base surface for facilitating sliding movement of the frame.

According to yet another preferred embodiment of the invention, the first and second brackets are angled and include a vertical segment and a horizontal segment, the horizontal segments for mounting on the base surface.

According to yet another preferred embodiment of the invention, the first and second brackets are positioned parallel to each other, and the frame includes front, rear and opposing side frame members interconnected to form a rectangular frame. The opposing side frame members are positioned parallel to the first and second brackets, and each of the opposing side frame members are connected to the slide assembly.

According to yet another preferred embodiment of the invention, a wheel is connected to the front frame member. The wheel is in contact with the base surface and facilitates sliding movement of the frame.

According to yet another preferred embodiment of the invention, the front, rear and opposing side frame members are releasably connected to each other, and the support further includes means for adjusting the points of connection between the front, rear and opposing side frame members to accommodate appliances of varying depth on the frame.

According to yet another preferred embodiment of the invention, the rear frame member is releasably connected to the opposing side frame members, and the support includes means for adjusting the points of connection between the rear frame member and the opposing side frame members to accommodate appliances of varying depth on said frame.

According to yet another preferred embodiment of the invention, the adjustment means includes a series of longitudinally spaced apart apertures formed in the opposing side frame members for receiving a fastener therethrough connecting the rear frame member to the opposing side frame members.

According to yet another preferred embodiment of the invention, the adjustment means includes a longitudinal slot formed in each of the opposing side frame members having a series of longitudinally spaced apart teeth for communicating with a fastener connecting the rear frame member to the opposing side frame members.

According to yet another preferred embodiment of the invention, the front, rear and opposing side frame members are angled and comprise a vertical segment and a horizontal segment. The frame members are interconnected at said horizontal segments.

According to yet another preferred embodiment of the invention, felt padding lines the interior side of the vertical segments of the frame members.

An embodiment of the method of moving an appliance according to the invention comprises the steps of providing a support comprising first and second brackets, a slide assembly connected to the first and second brackets, and a rectangular frame connected to the slide assembly for slidable movement relative to the first and second brackets. The first and second brackets are mounted on a base surface. The appliance is mounted on the rectangular frame, and is moved by sliding the rectangular frame relative to the first and second brackets.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
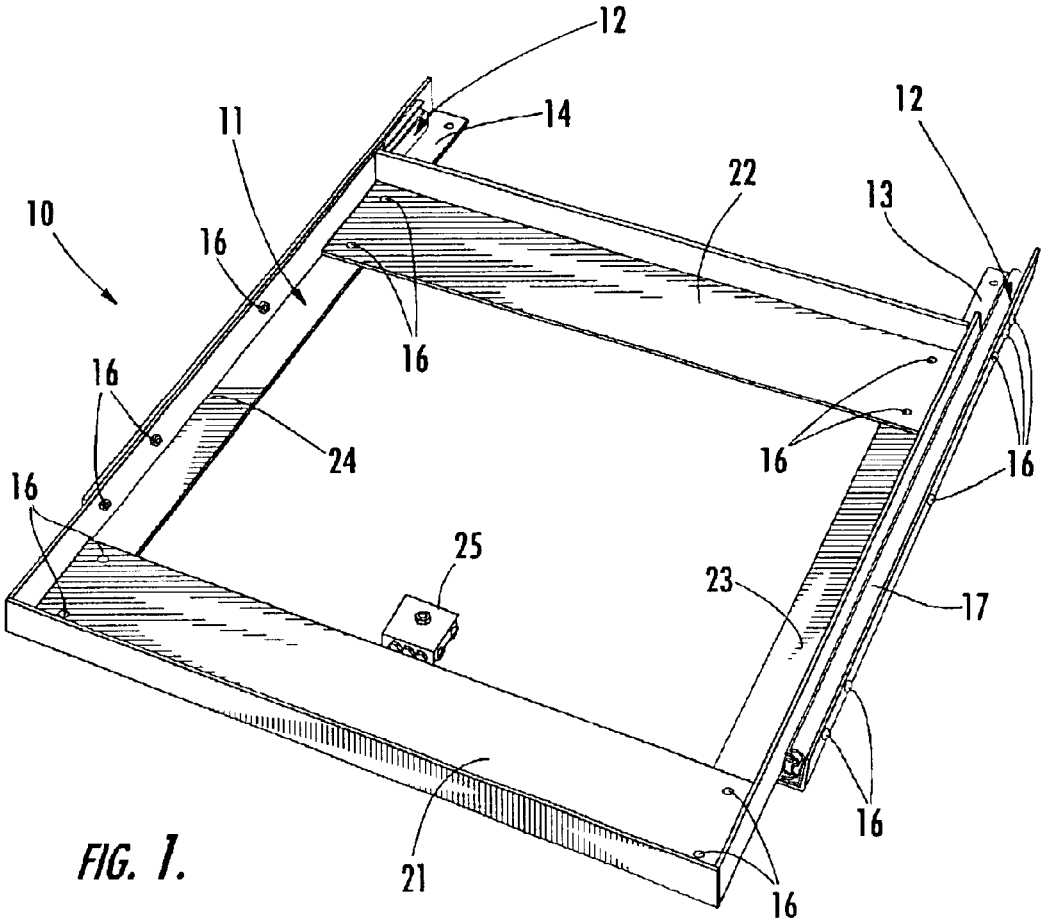
FIG. 1 is a perspective view of a preferred embodiment of a support for a washer or dryer according to the invention.

Referring now specifically to the drawings, a preferred embodiment of the appliance support according to the present invention is illustrated in FIG. 1, and shown generally at reference numeral 10. As shown in FIG. 1, the support 10 comprises a rectangular frame 11 affixed to a slide assembly 12 connected to two brackets 13, 14. The support 10 is preferably made of aluminum. A large household appliance, such as a washing machine "M", is mounted on the frame 11 as shown in FIGS. 3 and 4.

Figure 2:
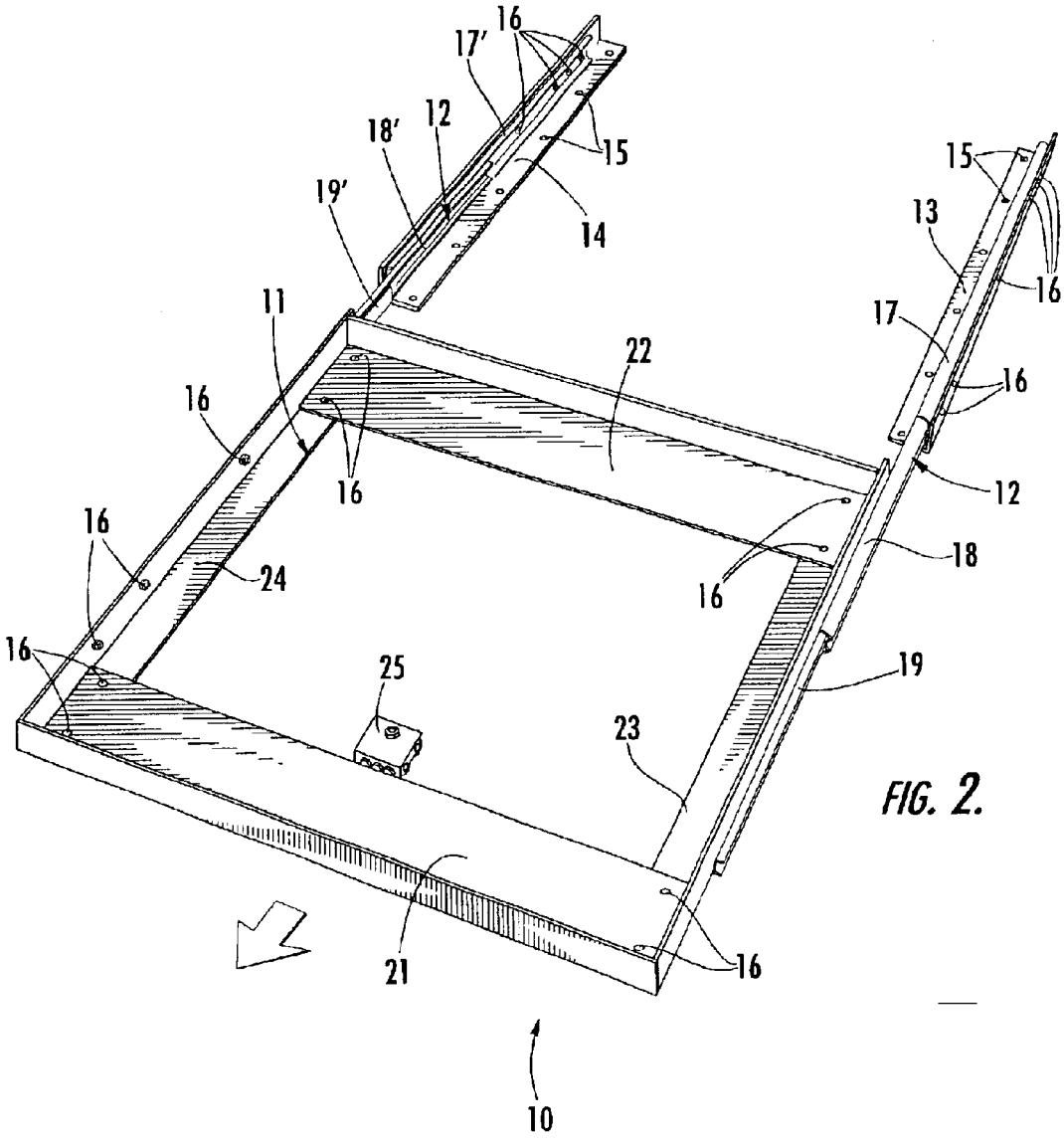
FIG. 2 is a perspective view of the preferred support shown in FIG. 1, with the frame in the extended position.
Figure 3:
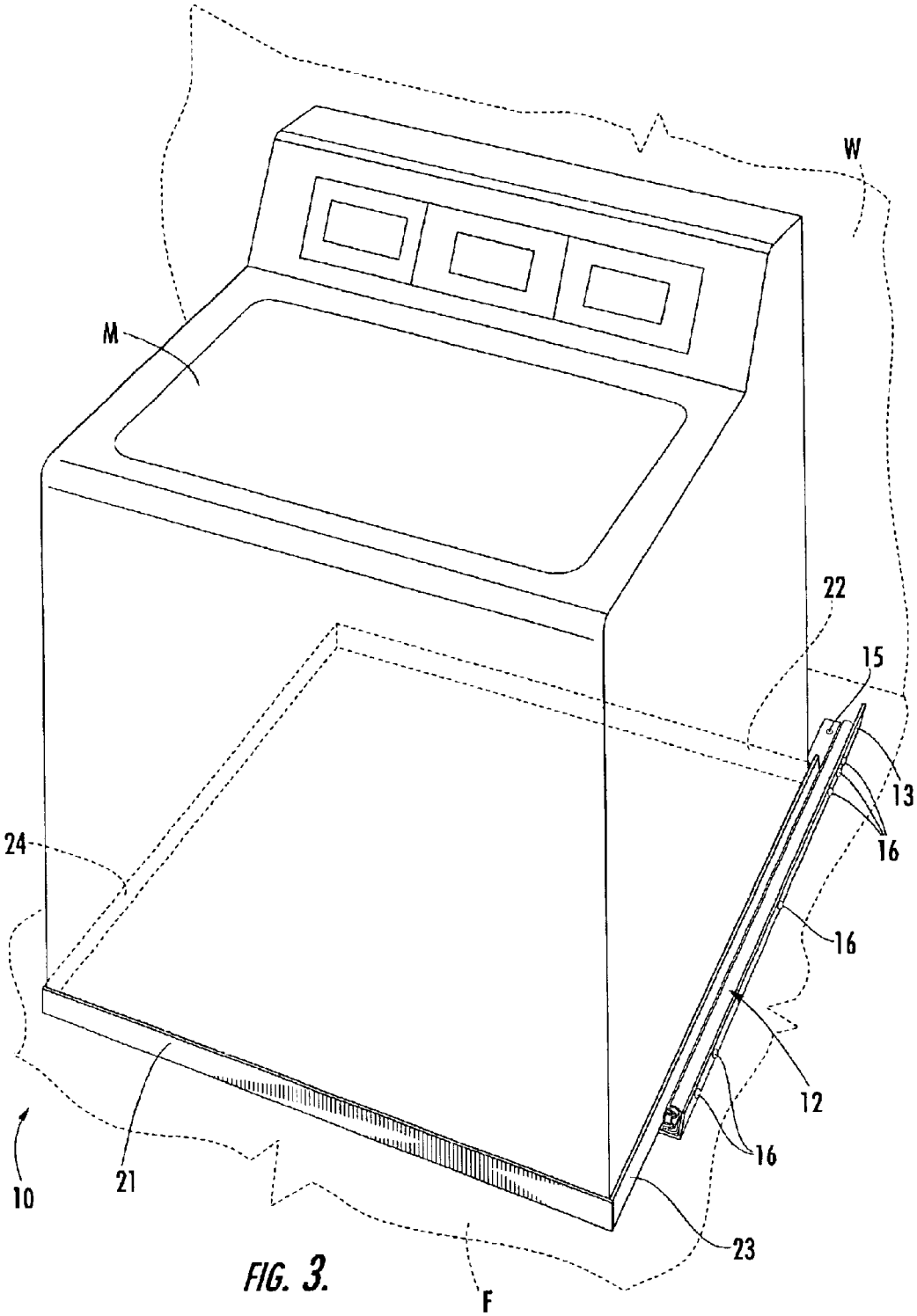
FIG. 3 is a perspective environmental view of the preferred support shown in FIG. 1, with a washing machine mounted on the support.
Figure 4:
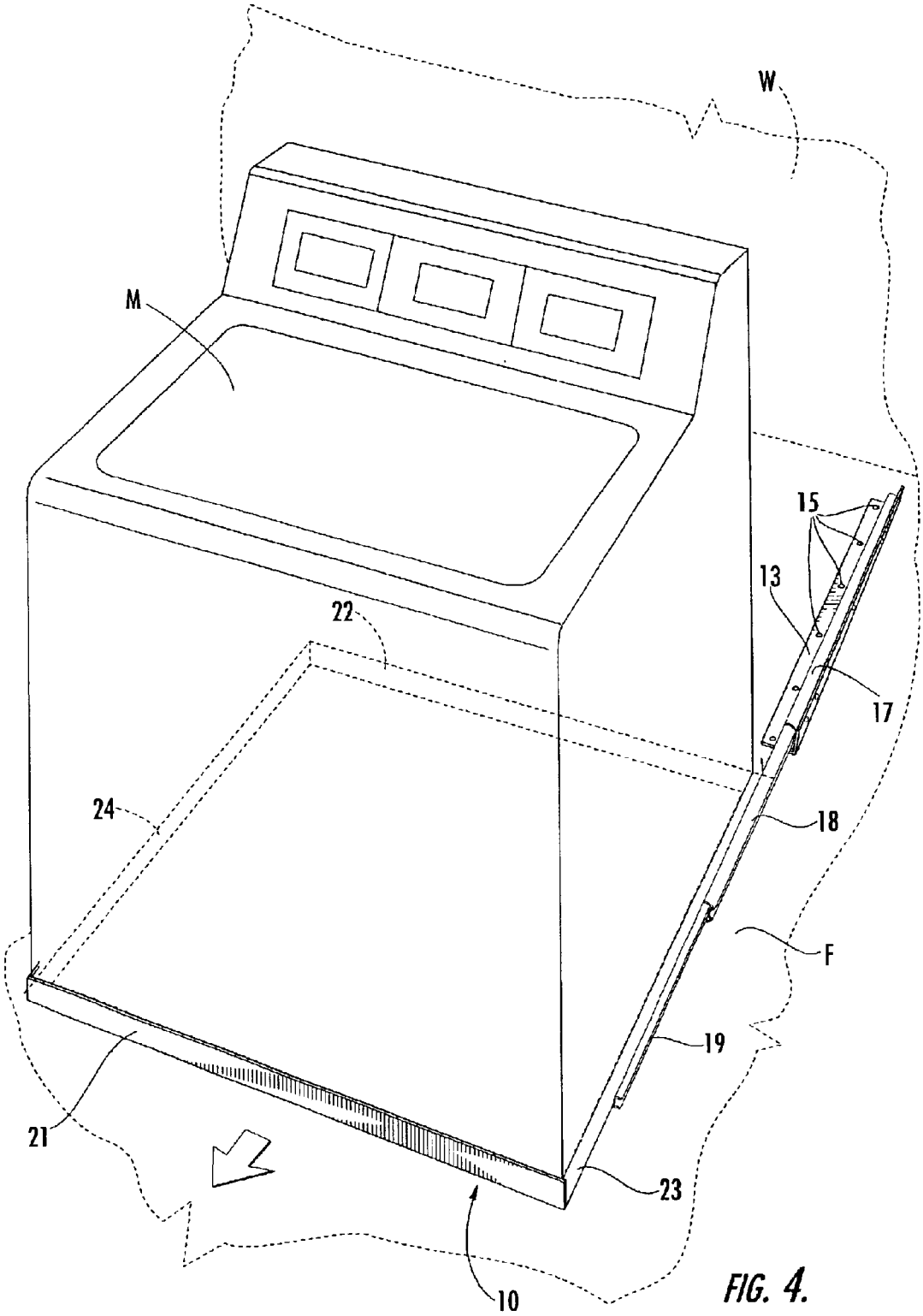
FIG. 4 is a perspective environmental view of the preferred support shown in FIG. 1 in the extended position.

As can best be seen in FIG. 2, the brackets 13, 14 are elongate members positioned parallel to each other and mounted on a base surface, such as a floor "F" (shown in FIGS. 3 and 4). Each of the brackets 13, 14 is angled to form a vertical segment extending upward and a horizontal segment that is attached to the floor "F", by fasteners 15 extending through apertures formed in the brackets 13, 14, as shown in FIGS. 2 and 4. The vertical segments of the brackets 13, 14 are attached to the slide assembly 12 by fasteners 16 extending through apertures formed in the brackets 13, 14 and the slide assembly 12, shown in FIGS. 2, 5 and 6.

Figure 9:
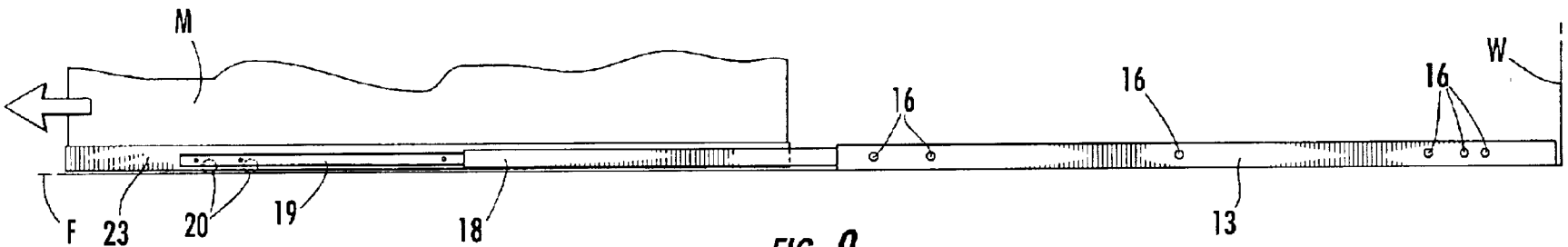
FIG. 9 is a partial side elevation of the preferred support shown in FIG. 1 in the extended position.

As shown in FIG. 2, the slide assembly 12 comprises two sets of three cooperating slide tracks 17, 18, 19 and 17', 18', 19' positioned on the brackets 13, 14, respectively. Slide track 17 is affixed to the bracket 13 by fasteners 16, such as nuts and bolts. Slide track 18 is positioned within slide track 17 and glides on steel ball bearings located within slide track 17 such that slide track 18 can move in relation to slide track 17, which remains stationary on bracket 13. A third slide track 19 is positioned within slide track 18 and similarly glides on steel ball bearings 20 positioned within slide track 18 such that slide track 19 can move in relation to slide track 18, as shown in FIG. 9. Slide track 17' is affixed to bracket 14, and slide tracks 17', 18', and 19' cooperate in the same fashion as slide tracks 17, 18, 19 described above. Slide tracks 19, 19' are connected to the frame 11 so that the frame moves in unison with slide tracks 19, 19'.

As shown in FIG. 1, the frame 11 is comprised of four interconnected elongate frame members: front frame member 21, rear frame member 22, right side frame member 23, and left side frame member 24. Each of the frame members 21, 22, 23, 24 is angled to form a vertical segment extending upward and a horizontal segment perpendicular to the vertical portion and extending parallel to the floor "F" (shown in FIGS. 3 and 4). Slide tracks 19, 19' are attached to side frame members 23, 24, respectively, by fasteners 16, as shown in FIGS. 2 and 9. The front frame member 21 is positioned on top of the horizontal segments of the side frame members 23, 24 at the front end of the side frame members 23, 24. Fasteners 16 extend through aligned apertures in the front frame member 21 and side frame members 23, 24. A wheel 25 is affixed at the center of the front frame member 21. The wheel 25 contacts the floor "F" and facilitates sliding movement of the frame 11.

Figure 5:
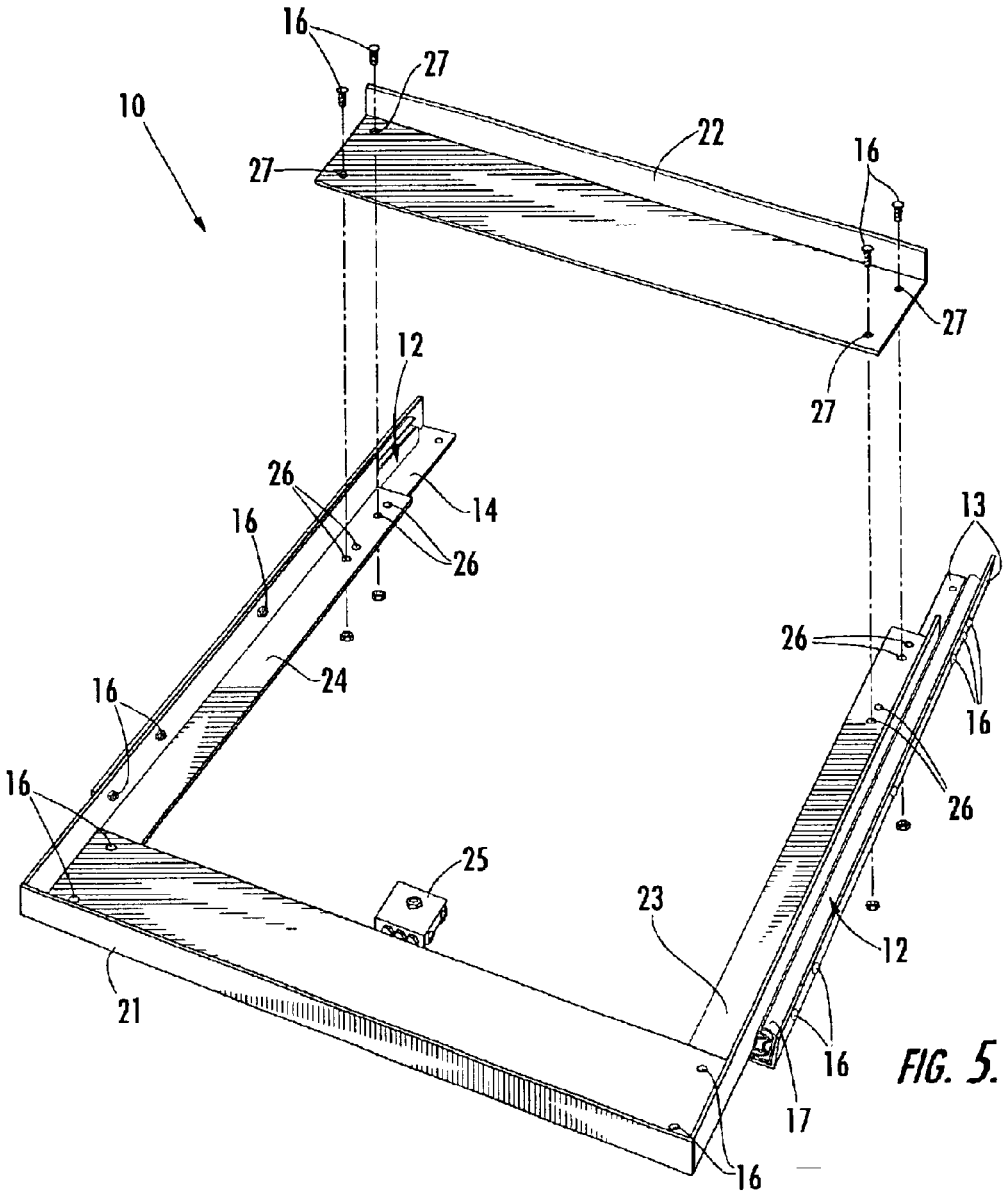
FIG. 5 is a partial exploded view of the preferred support shown in FIG. 1, with the frame being assembled in a short position.
Figure 6:
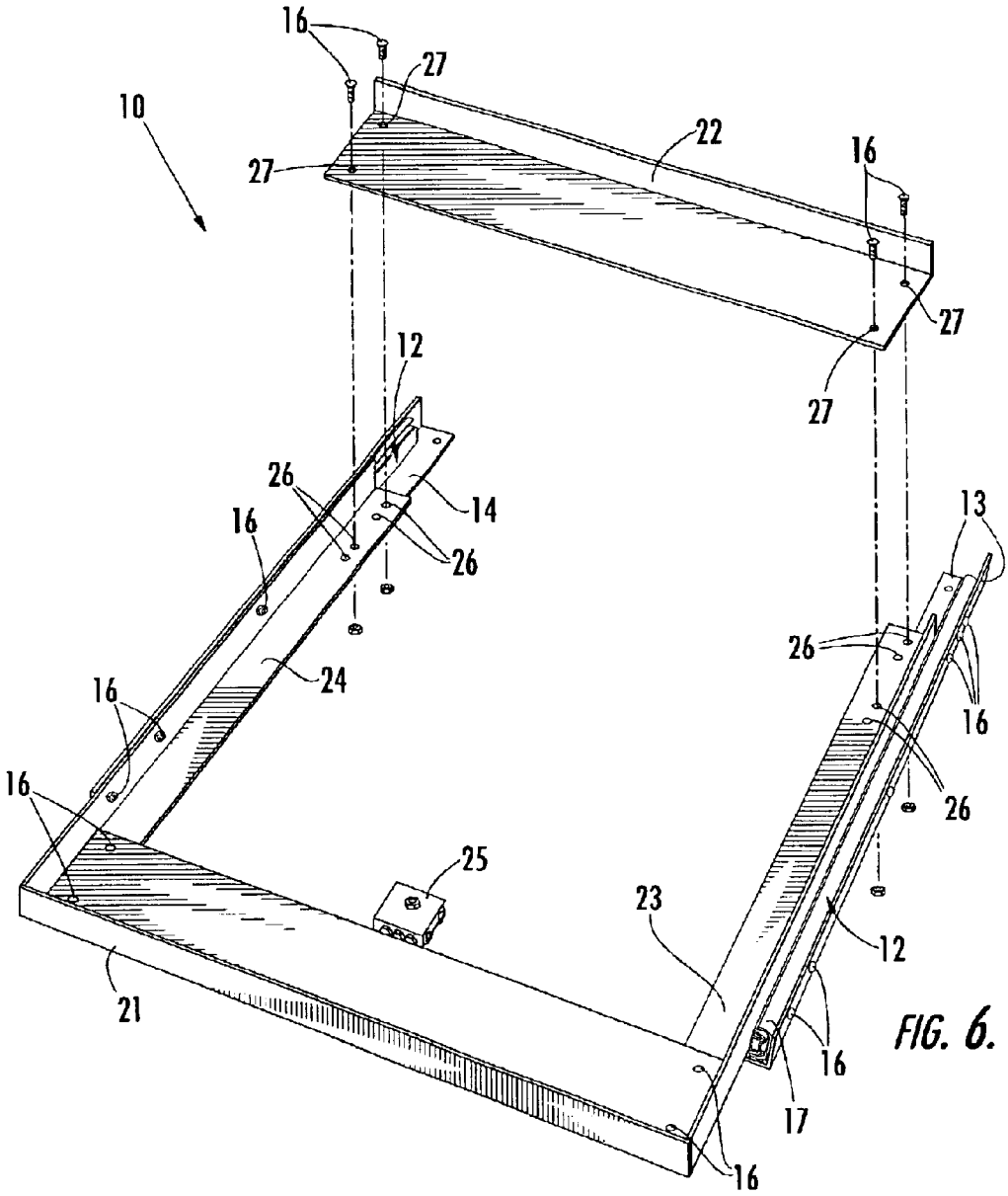
FIG. 6 is a partial exploded view of the preferred support shown in FIG. 1, with the frame being assembled in a long position.

The rear frame member 22 is positioned on the horizontal segments of the side frame members 23, 24 proximate the rear end of the side frame members 23, 24. As shown in FIGS. 5 and 6, each of the side frame members 23, 24 has a series of four linearly aligned apertures 26 proximate the rear end of the side frame members 23, 24. The rear frame member 22 includes two pairs of linearly aligned apertures 27 located at opposing ends of the rear frame member to correspond to the apertures 26 of side frame members 23, 24. The rear frame members 22 is mounted on the side frame members 23, 24 by fasteners 16 extending through aligned apertures 26, 27. The apertures 26, 27 are spaced apart on side frame members 23, 24 and rear frame member 22, respectively, such that the rear frame member 22 can be mounted on the side frame members 23, 24 in a short position, shown in FIG. 5, in which the total length of the frame 11 is approximately twenty-seven inches, or in a longer position, shown in FIG. 6, in which the total length of the frame 11 is approximately thirty inches. As such, the length of the frame 11 can be adjusted to accommodate washing machines and dryers having standard depths of approximately twenty-five to twenty-nine inches.

Figure 7:
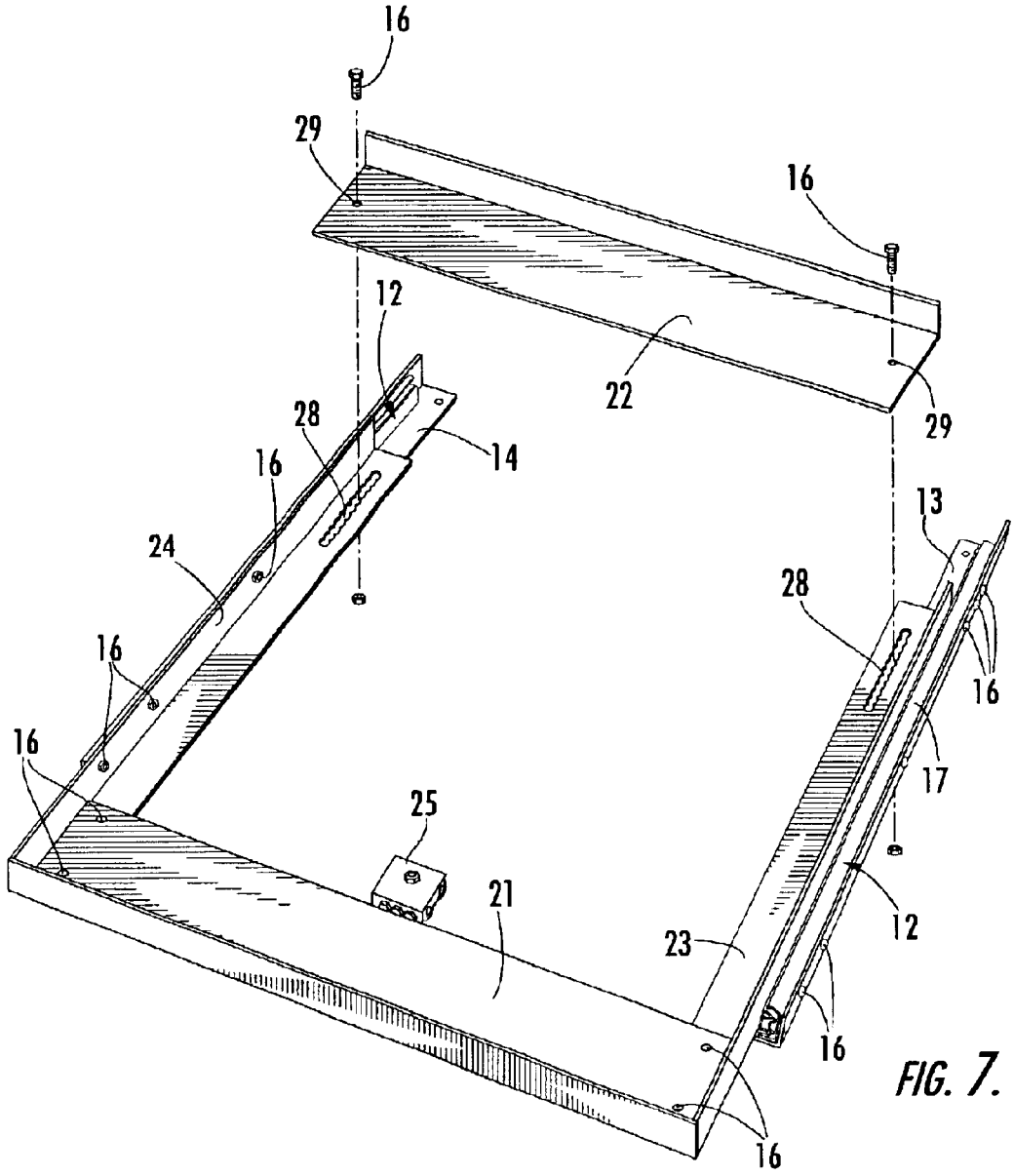
FIG. 7 is a partial exploded view of another preferred embodiment of a support for a washer or dryer according to the invention.
Figure 8:
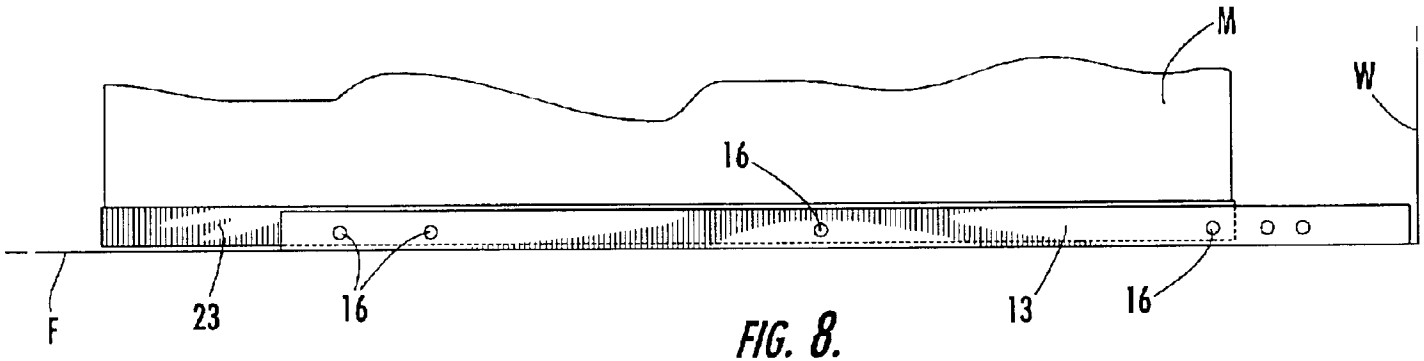
FIG. 8 is a partial side elevation of the preferred support shown in FIG. 1.

More precise variations in the length of the frame 11 can be achieved in an alternative embodiment of the invention shown in FIG. 7. In the alternative embodiment, side frame members 23, 24 each include an elongate slot 28 proximate the rear end of the side frame members 23, 24. Each slot 28 has a plurality of protruding teeth spaced apart along each longitudinal side of the slot 28 defining a series of linearly aligned holes in which a fastener 16 extending through apertures 29 in the rear frame member 22 is inserted to connect the rear frame member 22 to the side frame members 23, 24. The length of the frame member 11 can be finely altered by inserting the fasteners 16 in various holes within the slots 28.

As shown in FIG. 3, a large household appliance, such as a washing machine "M", is positioned on the frame 11 such that the front of the washing machine "M" faces the front frame member 21. The washing machine "M" rests on the horizontal segments of the frame members 21, 22, 23, 24.

The vertical segments of the frame members 21, 22, 23, 24 support and stabilize the washing machine "M". The washing machine "M" and support 10 are typically mounted proximate to a wall "W" to avoid obstruction of movement through the middle of a room. In order to access the portion of the floor "F" proximate to the wall "W" that is covered by the washing machine "M", slide tracks 18, 19, 18', 19' are moved away from the brackets 13, 14, as shown in FIGS. 3, 4, 8 and 9, thereby moving frame 11 away from the wall "W". The washing machine "M" moves in unison with the frame 11 and is easily moved away from the wall "W", thereby allowing access to the portion of the floor "F" that is usually covered by the washing machine "M."

A support for an appliance and method of using same is disclosed above. Various embodiments of the invention can be made without departing from its scope. Furthermore, the foregoing description of the preferred embodiment of the invention and the best mode for practicing the invention are provided for the purpose of illustration only and not for the purpose of limitation—the invention being defined by the claims.

I claim:

1. A support for moving an appliance comprising:

(a) first and second brackets for mounting in a stationary position on a base surface;

(b) a slide assembly connected to said first and second brackets;

(c) a frame comprising a plurality of frame members, at least one of said frame members comprising a base segment parallel to the base surface for mounting the appliance thereon and a sidewall segment extending upwardly from said base segment for stabilizing the appliance on said frame, said frame connected to said slide assembly for slidable movement relative to said first and second brackets whereby said appliance moves in unison with said frame; and (d) wherein each of said frame members comprises a base segment parallel to the base surface for mounting the appliance thereon and a sidewall segment extending upwardly from said base segment of said frame members and above said slide assembly for stabilizing the appliance positioned on the frame, said frame members interconnected at said respective base segments to form said frame.

2. A support for moving an appliance according to claim 1, wherein the appliance is a washing machine or dryer.

3. A support for moving an appliance according to claim 1 further comprising means for adjusting the dimensions of the perimeter of said frame to accommodate appliances of varying size.

4. A support for moving an appliance according to claim 1, wherein said slide assembly comprises:

(a) a first plurality of interconnected slide tracks cooperating with each other and a plurality of rollers disposed within at least one of said slide tracks to facilitate sliding movement, at least one of said slide tracks affixed to said first bracket and at least one of said slide tracks connected to said frame; and (b) a second plurality of slide tracks cooperating with each other and a plurality of rollers disposed within at least one of said slide tracks to facilitate sliding movement, at least one of said slide tracks affixed to said second bracket and at least one of said slide tracks connected to said frame, whereby said frame moves in unison with said slide tracks connected thereto.

5. A support for moving an appliance according to claim 1, further comprising a wheel attached to said frame and in contact with the base surface for facilitating sliding movement of the frame.

6. A support for moving an appliance according to claim 1, wherein said first and second brackets are angled and comprise a vertical segment and a horizontal segment, said horizontal segments for being mounted on the base surface.

7. A support for moving an appliance according to claim 1, wherein:

(a) said first and second brackets are positioned parallel to each other;

(b) said frame comprises front, rear and opposing side frame members interconnected to farm a rectangular frame;

(c) said opposing side frame members positioned parallel to said first and second brackets; and (d) each of said opposing side frame members are connected to said slide assembly.

8. A support for moving an appliance according to claim 7, wherein a wheel is connected to said front frame member in contact with the base surface for facilitating sliding movement of said frame.

9. A support for moving an appliance according to claim 7, wherein said front, rear and opposing side frame members are releasably connected to each other, and further comprising adjustment means for adjusting the points of connection between said front, rear and opposing side frame members to accommodate appliances of varying depth on said frame.

10. A support for moving an appliance according to claim 7, wherein said rear frame member is releasably connected to said opposing side frame members, and further comprising adjustment means for adjusting the points of connection between said rear frame member and said opposing side frame members to accommodate appliances of varying depth on said frame.

11. A support frame for an appliance according to claim 10, wherein said adjustment means comprises a series of longitudinally spaced apart apertures formed in said opposing side frame members for receiving a fastener therethrough connecting said rear frame member to said opposing side frame members.

12. A support frame for an appliance comprising, (a) first and second brackets for mounting on a base surface, said first and second brackets positioned parallel to each other;

(b) a slide assembly connected to said first and second brackets;

(c) a frame comprising front, rear and opposing side frame members, at least one of said frame members comprising a base segment parallel to the base surface for mounting the appliance thereon and a sidewall segment extending upwardly from said base segment for stabilizing the appliance on said frame, said opposing side frame members positioned parallel to said first and second brackets and connected to said slide assembly for slidable movement relative to said first and second brackets whereby said appliance moves in unison with said frame, and said rear frame member releasably connected to said opposing side frame members; and (d) adjustment means for adjusting the points of connection between said rear frame member and said opposing side frame members to accommodate appliances of varying depth on said frame, said adjustment means comprising a longitudinal slot formed in each of said opposing side frame members having a series of longitudinally spaced apart teeth for communicating with a fastener connecting said rear frame member to said opposing side frame members.

13. A support for moving an appliance according to claim 1, further comprising felt padding lining an interior side of the sidewall segments of said frame members.

14. A support for moving an appliance according to claim 1, wherein said plurality of frame members comprises front, rear and opposing side frame members interconnected at said respective base segments to form a rectangular frame.

15. A support for moving an appliance according to claim 1, wherein said sidewall segment is perpendicular to said base segment.

16. A support for moving an appliance according to claim 1, wherein said first and second brackets each define at least one aperture for inserting a fastener therethrough for mounting said first and second brackets in a stationary position on the base surface.

17. A support for moving an appliance according to claim 1, wherein said slide assembly comprises:

(a) first, second and third slide tracks cooperating with each other and a plurality of rollers disposed within at least one of said slide tracks to facilitate sliding movement, said first slide track connected to said first bracket, said second slide track connected to said frame, and said third slide track operatively engaged to said first and said second slide tracks; and (b) fourth, fifth and sixth slide tracks cooperating with each other and a plurality of rollers disposed within at least one of said slide tracks to facilitate sliding movement, said fourth slide track connected to said first bracket, said fifth slide track connected to said frame, and said sixth slide track operatively engaged to said fourth and said fifth slide tracks, whereby said frame moves in unison with said slide tracks connected thereto.

18. A support for moving an appliance according to claim 12, wherein said slide assembly comprises:

(a) a first plurality of interconnected slide tracks cooperating with each other and a plurality of rollers disposed within at least one of said slide tracks to facilitate sliding movement, at least one of said slide tracks affixed to said first bracket and at least one of said slide tracks connected to said frame; and (b) a second plurality of slide tracks cooperating with each other and a plurality of rollers disposed within at least one of said slide tracks to facilitate sliding movement, at least one of said slide tracks affixed to said second bracket and at least one of said slide tracks connected to said frame, whereby said frame moves in unison with said slide tracks connected thereto.

* * * * *

UNITED STATES PATENT AND TRADEMARK OFFICE

CERTIFICATE OF CORRECTION

PATENT NO. : 6,820,850 B2
DATED : November 23, 2004
INVENTOR(S) : Coleman, Clarence M.

It is certified that error appears in the above-identified patent and that said Letters Patent is hereby corrected as shown below:

Column 6,
Line 12, delete “farm” and enter -- form --.

Signed and Sealed this

Twenty-ninth Day of November, 2005

JON W. DUDAS
*Director of the United States Patent and Trademark Office*